United States Patent [19]

Krachman

[11] 4,102,558

[45] Jul. 25, 1978

[54] NON-SHOCKING PIN FOR FLUORESCENT TYPE TUBES

[75] Inventor: Howard Ellis Krachman, Pasadena, Calif.

[73] Assignee: Developmental Sciences, Inc., Industry, Calif.

[21] Appl. No.: 828,772

[22] Filed: Aug. 29, 1977

[51] Int. Cl.[2] ..... H01J 5/50

[52] U.S. Cl. ..... 339/144 R; 313/318; 339/145 D

[58] Field of Search ..... 339/50 R, 53, 144 R, 339/195 D, 175, 178 T; 313/318, 491, 271, 217, 219, 220

[56] References Cited

U.S. PATENT DOCUMENTS

| | | | |
|---|---|---|---|
| 2,385,340 | 9/1945 | Baxter | 339/145 D |
| 2,680,236 | 6/1954 | Kuebler | 339/145 D |
| 3,855,495 | 12/1974 | Pappas et al. | 313/220 X |

*Primary Examiner*—Roy Lake
*Assistant Examiner*—E. F. Desmond
*Attorney, Agent, or Firm*—Blakely, Sokoloff, Taylor & Zafman

[57] ABSTRACT

An improved terminal pin for use with the bi-pin type end caps of fluorescent discharge tubes to reduce electrical shock hazards is disclosed. The pin comprises a body portion, a tip portion of reduced thickness relative to that of the body portion, and insulation covering the tip portion. The end cap utilizing the subject terminal pin is compatible with conventional lamp sockets.

12 Claims, 5 Drawing Figures

Fig. 1
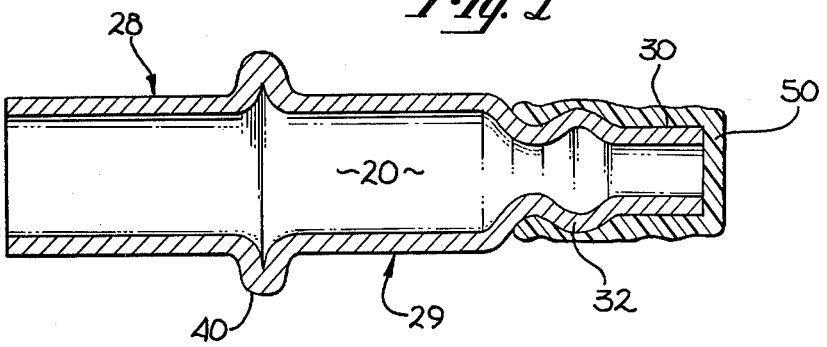
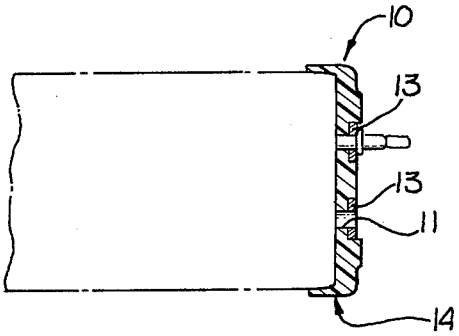
Fig. 3
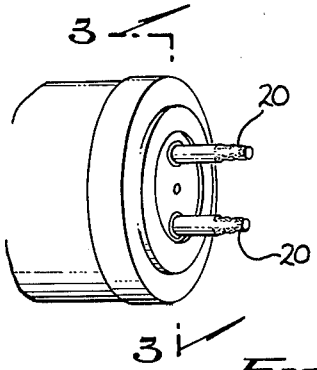
Fig. 2
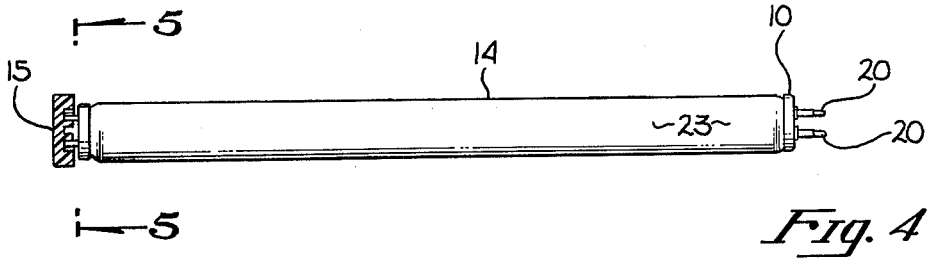
Fig. 4
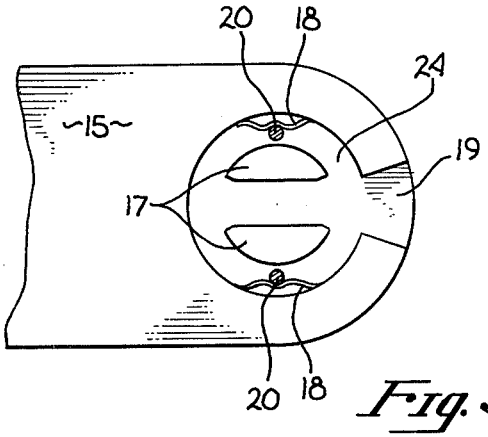
Fig. 5

NON-SHOCKING PIN FOR FLUORESCENT TYPE TUBES

BACKGROUND OF THE INVENTION:

1. Field of the Invention:

The present invention relates to the field of terminal pins and end caps for fluorescent discharge tubes and tube substitutes, and in particular to terminal pins which prevent and reduce electrical shock hazard.

2. Description of Prior Art:

Fluorescent discharge tubes have long been used as an economical source of artificial light. These tubes comprise elongated glass envelope tubes and contain the electrically activated, light-generating elements with end caps at the ends thereof to seal the tube and provide means for making electrical contact with the electrical elements therein. One common type of end cap is the bi-pin cap which utilizes a pair of pin terminals to connect to the corresponding lamp sockets. This type of end cap presents a shock hazard when the lamp is incorrectly installed and one end pin is left exposed out of the lamp holder. Also, if one end of an energized "hot" fluorescent tube is removed from its socket, a person inadvertently touching an exposed pin may be shocked. A hazard similarly exists with the so-called "dummy" tubes, i.e., tubes that contain no light generating elements, but rather contain simply a capacitor connecting one terminal pin at one end of the tube to the corresponding terminal pin at the other end, so as to provide electrical continuity between the lamp sockets without generating additional light. These tubes have become increasingly used in situations where a dual tube assembly is used, and when, due to energy conservation measures or the like, only the light from, and power consumption of, a single fluorescent tube is desired. A shock hazard is presented when one end of the tube is placed in the energized lamp socket and the other end is exposed; since the capacitor presents essentially a short circuit between the two pins and inadvertent contact with the exposed pin will likely cause a shock. The capacitor acts as a current limiter and the magnitude of this shock is less than that of a fluorescent lamp.

In the past, this problem has not received much attention by the lamp manufacturers, and through careful use or experience, the number of people shocked was kept to a minimum. With the increased use of the dummy tubes and the advent of consumer protection awareness, additional attention has been focused on the shock hazards. The subject invention greatly reduces the potential hazard of electrical shock, and provides a terminal pin compatible with conventional lamp sockets.

SUMMARY OF THE INVENTION

An improved terminal pin for use in connection with the bi-pin type end caps of fluorescent discharge tubes is disclosed. A terminal pin comprises first and second body portions, separated by a projecting encircling boss, a tip portion of reduced thickness with respect to the body portions, and insulation covering substantially all the outer surface of the tip portion. The tip portion includes a protrusion extending around the circumference of the tip acting as a retaining surface to prevent the insulation from slipping off the tip portion. The first body portion of the pin is inserted in an opening in the end cap having a size greater than the diameter of the pin body, but less than that of the boss. The boss engages the surface of the end cap and positively defines the length of the portion of the pin projecting from the cap. The pins are compatible with conventional lamp sockets and present less electrically conductive area to persons handling the fluorescent tubes, thereby substantially reducing the shock hazard.

BRIEF DESCRIPTION OF THE DRAWINGS

FIG. 1 is a cross-sectional view of the subject terminal pin, taken through an axial plane.

FIG. 2 is a perspective view of an end cap with the subject terminal pins installed on a fluorescent tube end cap.

FIG. 3 is a cross-sectional view of the end cap with a terminal pin installed.

FIG. 4 is an elevation view of a fluorescent discharge tube provided with the subject terminal pins, and a conventional lamp socket.

FIG. 5 is a view of the lamp socket, taken along line 5—5 shown in FIG. 4.

DETAILED DESCRIPTION OF THE INVENTION

Referring now to FIGS. 3, 4 and 5, the fluorescent tube, end cap, and lamp socket with which the subject invention may be utilized are shown. FIG. 4 shows a standard tubular fluorescent discharge lamp such as are in common use and available in various lengths. An end cap 10 is used to fit over each end of the sealed lamp tube and provides an electrical connection with the lamp. To provide contact with the electrical elements within the tube, two terminal pins extend through spaced holes in each end cap, to which leads attached to the electrical elements are coupled. The end caps are inserted into lamp sockets such as are shown in FIG. 5, to connect a source of electrical energy to the discharge tube. These conventional lamp sockets comprise a body 15 of insulating material, having slot 19 and circular cavity 24 formed therein. Flatsided members 17 are also formed of insulating material, and are typically integrally molded with body 15. Spring contacts 18 comprise resilient, electrically energized conductors. The tube 23 is aligned between the two lamp sockets so that the terminal pins of the end cap are in line with slots 19. The tube is then manipulated so that the pins 20 are inserted through slot 19 into cavity 24. The tube 23 is then rotated axially 90° so that the sides of terminal pins 20 engage contacts 18, which are formed with indentations into which the pins are engaged and locked (as shown in FIG. 5).

Referring now to FIG. 1, an axial cross-sectional view of the preferred embodiment of the subject invention is shown. Terminal pin 20 is a hollow, elongated member of circular cross-section, comprising generally a first body portion 28, second body portion 29, and tip portion 30. Tip portion 30 has a reduced cross-sectional diameter with respect to that of the second body portion 29. Encircling protrusion 32 is formed around the periphery of the tip portion adjacent the second body portion 29. Encircling boss 40 separates the first body portion 28 from the second body portion 29.

Insulation material 50 is installed around the tip portion 30 of the pin 20, covering substantially the entire outer surface thereof. This insulation is preferably a hard plastic or vinyl material and is subjected to a heat shrinking process so that the insulation shrinks to fit tightly around the tip portion 30. It is important that the maximum thickness of the insulation material and the diameter of the tip 30 be controlled so that the combined thickness of the tip portion with insulation does not exceed that of the second body portion 29 along the portions of the pin which make electrical contact with the connection. Protrusion 32 serves to retain the insulation 50 in place and prevent its dislodging under an axially directed force. Of course, other means might be utilized to retain the insulation; for example, the surface of tip portion 30 might be roughened or knurled to form small gripping projections.

A pair of the terminal pins 20 is inserted into spaced openings 11 formed in end cap 10. End cap 10 comprises a disclike member having annular flange 14 disposed around the periphery thereof. The inner diameter of the cap 10 is selected to fit over the ends of the standard fluorescent tube. The cap 10 is secured in place at the tube end with a suitable cement or adhesive. Openings 11 are formed on a diametral line of the cap, and are formed with recesses 13 on the outer sides thereof; the diameter of opening 11 is larger than that of the first body portion of pin 20, and somewhat smaller than the outer diameter of boss 40.

The first body portion 28 of the pin 20 is inserted into opening 11 from the outer side of the cap 10. Since the external diameter of boss 40 is greater than the diameter of opening 11, boss 40 will contact the cap material surrounding opening 11 and prevent any further insertion of the pin 20. Thus, the length of the pin protruding from the outer surface of cap 10 is fixed by the location of boss 40. The depth of recess 13 is approximately to the depth of boss 40, so that boss 40 is substantially recessed below the exposed surface of cap 10, to prevent interference with lamp socket 15. The pin 20 may be secured in position by splitting first body portion 28 extending from the cap 10 into lengthwise segments and bending these segments outward against the interior surface of the cap 10. Alternative securing means may be utilized to secure the pin in place, as for example, forcefitting the pin in opening 10, or threading the exterior surface of first pin portion 28 for threadable engagement with a tightening nut. The lead connecting to the electrical elements in the tube 14 may be inserted into the hollow pin 20 and soldered in place. Pin 20 is fabricated from materials having good conduction properties such as brass or copper.

The spacing of holes 11 is chosen so that the cap 10 with pins 20 may be utilized in connection with the conventional lamp sockets discussed hereinabove. Since the insulation 50 extends only along the tip portion 30, which portion has a reduced diameter with respect to second body portion 29, electrical contact may be made between a portion of the surface of second body portion 29 and contacts 18 of the lamp connector. As previously noted, the maximum thickness of the insulation is controlled so that contact with conducting second body portion 29 and electrical contact 18 is not prevented.

It has been found that the hazard of electrical shock from touching the terminal pins of fluorescent discharge tubes during installation is greatly reduced, if not eliminated, by the placement of the insulation around the tip portion of the pin 20. The relative dimensions of the length of the tip portion 30 and the length of the second pin body 29 can, of course, be selected to provide the maximum protection; sizes which have been found to provide good protection and still maintain good electrical contact between the pin and lamp socket are approximately 0.18 inch for the length of the second body portion and approximately 0.12 inch for the length of the tip portion. With these dimensions, the pin will provide sufficient contact with the conventional lamp sockets and the needed electrical insulation properties to prevent accidental shocks to persons installing or removing the lamps.

Of course, the invention may be used in other ways and for other devices. For example, dummy light tubes are often used in dual fluorescent discharge tube assemblies to provide electrical continuity between the lamp sockets, without generating additional light. These dummy tubes typically comprise a glass tube with end caps and terminals, the only internal electrical connection to the terminals being a capacitor connected between a corresponding terminal of each end cap. Terminal pins embodying the present invention may be used with the end caps of such dummy tubes to provide the electrical contact required.

Although this invention has been disclosed and described with reference to particular embodiments, the principles involved are susceptible of other applications which will be apparent to persons skilled in the art. This invention, therefore, is not intended to be limited to the particular embodiment herein described. Various changes in the form, detail and application of the subject terminal pin may be made therein without departing from the spirit and scope of the invention.

I claim:

1. The terminal pin of electrically conducting material for use with end caps of fluorescent discharge tubes and the like comprising:

an elongated pin body portion;

a tip portion extending from an end of said body portion, said tip portion having a reduced thickness with respect to that of said body portion; and insulation covering substantially all the exterior surface of said tip portion.

2. The terminal pin of claim 1 wherein said tip portion includes a projection covered by said insulation, wherein said projection tends to prevent removal of said insulation by an axially directed force.

3. The terminal pin of claim 1 wherein said pin body portion is divided into a first body portion and a second body portion by a projecting member.

4. The terminal pin of claim 3 wherein said projecting member comprises an encircling boss.

5. The terminal pin of claim 1 wherein said pin body is hollow.

6. The terminal pin for use with end caps of fluorescent discharge tubes and the like comprising:

a hollow, elongated pin body having a circular cross-section, divided into a first body portion and a second body portion by an encircling boss;

a tip portion extending from an end of said body portion, said tip portion having a reduced thickness with respect to that of said body portion, and further including an encircling projection; and non-conducting insulating material covering substantially the entire exterior surface of said tip portion.

7. The connector end cap for fluorescent discharge tubes and the like comprising:

disc member having an annular flange disposed around the periphery thereof;

a pair of openings formed in said disc member;

a pair of terminal pins, one each inserted through each of said openings, each of said pins having an elongated body portion and a tip portion extending from an end of said body portion having a reduced thickness with respect to that of said body portion;

insulation for covering substantially all the exterior surface of said tip portion; and means for securing said pin in said opening;

whereby the electrical elements within said tube may be electrically coupled to said pins for connection to a source of electrical energy, and said insulation reduces the electrically conducting surface area of said pin exposed to persons handling such tubes.

8. The end cap of claim 6 wherein said tip portion of said pin includes a projection covered by said insulation, wherein said projection tends to prevent removal of said insulation by an axially directed force.

9. The terminal pin of claim 7 wherein said pin body is hollow.

10. The terminal pin of claim 7 wherein said pin body portion is divided into a first body portion and a second body portion by a projecting member.

11. The terminal pin of claim 10 wherein said projecting member comprises an encircling boss.

12. The end cap of claim 11 wherein recesses are provided in said disc member adjacent said openings for receiving said bosses.

* * * * *